US011913189B2

(12) United States Patent
Lee

(10) Patent No.: US 11,913,189 B2
(45) Date of Patent: Feb. 27, 2024

(54) BUCKET FOR EXCAVATOR

(71) Applicant: Kang Jun Lee, Seosan-si (KR)

(72) Inventor: Kang Jun Lee, Seosan-si (KR)

( * ) Notice: Subject to any disclaimer, the term of this patent is extended or adjusted under 35 U.S.C. 154(b) by 386 days.

(21) Appl. No.: 17/277,350

(22) PCT Filed: May 18, 2020

(86) PCT No.: PCT/KR2020/006493
§ 371 (c)(1),
(2) Date: Mar. 18, 2021

(87) PCT Pub. No.: WO2021/060643
PCT Pub. Date: Apr. 1, 2021

(65) Prior Publication Data

US 2021/0388573 A1 Dec. 16, 2021

(30) Foreign Application Priority Data

Sep. 23, 2019 (KR) ..... 10-2019-0116926

(51) Int. Cl.
*E02F 3/40* (2006.01)

(52) U.S. Cl.
CPC ..... *E02F 3/40* (2013.01)

(58) Field of Classification Search
CPC ..... E02F 3/40; E02F 3/60; E02F 3/401
See application file for complete search history.

(56) References Cited

U.S. PATENT DOCUMENTS

| | | | | | |
|---|---|---|---|---|---|
| 4,213,731 | A * | 7/1980 | Verachtert | E02F 3/3622 414/723 |
| 8,069,593 | B2 * | 12/2011 | McClallen | E02F 3/40 37/444 |
| 9,663,917 | B2 * | 5/2017 | Fujii | E02F 3/3677 |
| 9,732,494 | B2 * | 8/2017 | Honda | E02F 3/40 |
| 2010/0037493 | A1 * | 2/2010 | Kim | E02F 3/40 37/444 |
| 2017/0089030 | A1 * | 3/2017 | Rochel | E02F 3/3677 |
| 2018/0087236 | A1 * | 3/2018 | Marek | E02F 3/40 |

FOREIGN PATENT DOCUMENTS

| | | | | |
|---|---|---|---|---|
| BE | 863093 | A * | 5/1978 | E02F 3/40 |
| CN | 106368250 | A | 2/2017 | |
| CN | 206768895 | U | 12/2017 | |
| CN | 113026840 | A | 6/2021 | |
| EP | 864697 | A1 * | 9/1998 | E02F 3/3622 |
| JP | 2000-017683 | A | 1/2000 | |
| JP | 2001-323497 | A | 11/2001 | |
| JP | 2001323497 | A * | 11/2001 | |
| JP | 2006-045785 | A | 2/2006 | |

(Continued)

*Primary Examiner* — Adam J Behrens
*Assistant Examiner* — Blake E Scoville
(74) *Attorney, Agent, or Firm* — Bridgeway IP Law Group, PLLC; Sang Ho Lee; Hyun Woo Shin

(57) ABSTRACT

A bucket for an excavator is provided. There is provided a bucket for an excavator to which both a general coupler and a tilt coupler are applicable, the bucket for an excavator having both an inner cavity formed between a cover portion and a support portion as a space having a quadrangular or polygonal shape and a coupling bracket extended to a rear surface thereof, thereby improving strength thereof.

6 Claims, 4 Drawing Sheets

(56) References Cited

FOREIGN PATENT DOCUMENTS

| | | | | |
|---|---|---|---|---|
| JP | 2006045785 | A | * | 2/2006 |
| KR | 100263532 | B1 | * | 8/2000 |
| KR | 20-0337294 | Y1 | | 12/2003 |
| KR | 20080098836 | A | * | 11/2008 |
| KR | 20130002388 | U | * | 4/2013 |
| KR | 10-2078029 | B1 | | 2/2020 |

* cited by examiner

BUCKET FOR EXCAVATOR

TECHNICAL FIELD

The disclosure relates to a bucket for an excavator, and in particular, to a bucket for an excavator to which both a general coupler and a tilt coupler for an excavator are applicable, the bucket for an excavator having both an inner cavity formed between a cover portion and a support portion as a space having a quadrangular or polygonal shape and a coupling bracket extended to a rear surface thereof, thereby improving strength thereof.

BACKGROUND ART

An excavator, which is a type of heavy equipment widely used for tasks of excavation, loading, and the like, can be used by coupling various buckets to an arm of the excavator while being moved using power. The excavator includes a general coupler capable of rotating a bucket only in a front-rear direction or a tilt coupler capable of rotating the bucket in a left-right direction as well, depending on a type of a bucket coupler that connects the bucket to the excavator. Accordingly, there is inconvenience in that the general bucket and the tilt coupler are alternately coupled to the bucket depending on a type of a task required.

DISCLOSURE OF THE INVENTION

Technical Subject

In order to address the above problem, an aspect of the disclosure provides a bucket for an excavator to which both a general coupler and a tilt coupler for the excavator are applicable, the bucket for an excavator having both an inner cavity formed between a cover portion and a support portion as a space having a quadrangular or polygonal shape and a coupling bracket extended to a rear surface thereof, thereby improving strength thereof.

Technical Solution

In order to achieve the above aspect, a bucket for an excavator according to an embodiment of the disclosure includes a bottom surface portion configured to form a floor of the bucket for an excavator, the bottom surface portion formed to be bent upward while extending in a rearward direction, a first side surface portion coupled to a first side surface of the bottom surface portion, a second side surface portion coupled to a second side surface of the bottom surface portion, a main body rod disposed between the first side surface portion and the second side surface portion, the main body rod coupled to each of the first side surface portion and the second side surface portion, a cover portion having one area coupled to the main body rod, the cover portion configured to form an upper surface of the bucket for an excavator, a support portion having one area coupled to the main body rod and another area coupled to the bottom surface portion, a first coupling bracket coupled to the main body rod, the cover portion, and the support portion, the first coupling bracket formed to protrude in a direction toward an outside of the bucket for an excavator, and a second coupling bracket formed at a position symmetrical to that of the first coupling bracket. The cover portion and the support portion are formed in a shape of being bent at least once, and an inner cavity formed between the cover portion and the support portion is formed as a space having a quadrangular or polygonal shape when viewed from a side surface.

In an embodiment, the first coupling bracket and the second coupling bracket may include a plurality of rod holes formed laterally therethrough, and the bucket for an excavator may further include a first coupling rod and a second coupling rod respectively inserted into and coupled to the rod holes, the first coupling rod and the second coupling rod coupled to a bucket coupler of an excavator.

In an embodiment, the cover portion may include an upper extension portion having one side coupled to the main body rod, the upper extension portion formed to extend in a rearward direction, and a first rear surface portion formed in a shape of being bent from the upper extension portion, the first rear surface portion having one side coupled to the support portion.

In an embodiment, the support portion may include a rod coupling portion having one side coupled to the main body rod, a lower extension portion formed in a shape of being bent from the rod coupling portion, the lower extension portion formed to extend in a rearward direction, and a second rear surface portion formed in a shape of being bent from the lower extension portion, the second rear surface portion having one side coupled to the bottom surface portion.

In an embodiment, each of the first coupling bracket and the second coupling bracket may include a central extension portion coupled to the main body rod and the upper extension portion, the central extension portion formed in a trapezoidal shape, a first rod insert coupled to the main body rod and formed on one side of the central extension portion, the first rod insert being that into which the first coupling rod is inserted, and a second rod insert coupled to the first rear surface portion and the second rear surface portion and formed on the other side of the central extension portion, the second rod insert being that into which the second coupling rod is inserted.

In an embodiment, the bucket for an excavator may further include at least one side surface reinforcement portion coupled to an outside of each of the first side surface portion and the second side surface portion to enhance the strength of the bucket for an excavator and at least one bottom surface reinforcement portion coupled to an outside of the bottom surface portion to enhance the strength of the bucket for an excavator.

In one embodiment, the bucket for an excavator may further include a first bracket reinforcement portion coupled to one side surface of the first coupling bracket and the main body rod, a second bracket reinforcement portion coupled to one side surface of the first coupling bracket and the cover portion, a third bracket reinforcement portion coupled to one side surface of the second coupling bracket and the main body rod, and a fourth bracket reinforcement portion coupled to one side surface of the second coupling bracket and the cover portion.

Effects of the Invention

The bucket for an excavator of the present invention has the advantages of being applicable to both a general coupler and a tilt coupler, having an inner cavity formed between a cover portion and a support portion as a space having a quadrangular or polygonal shape, and improving strength thereof by a coupling bracket extended to a rear surface thereof.

BEST MODE FOR CARRYING OUT THE INVENTION

Figure 1:
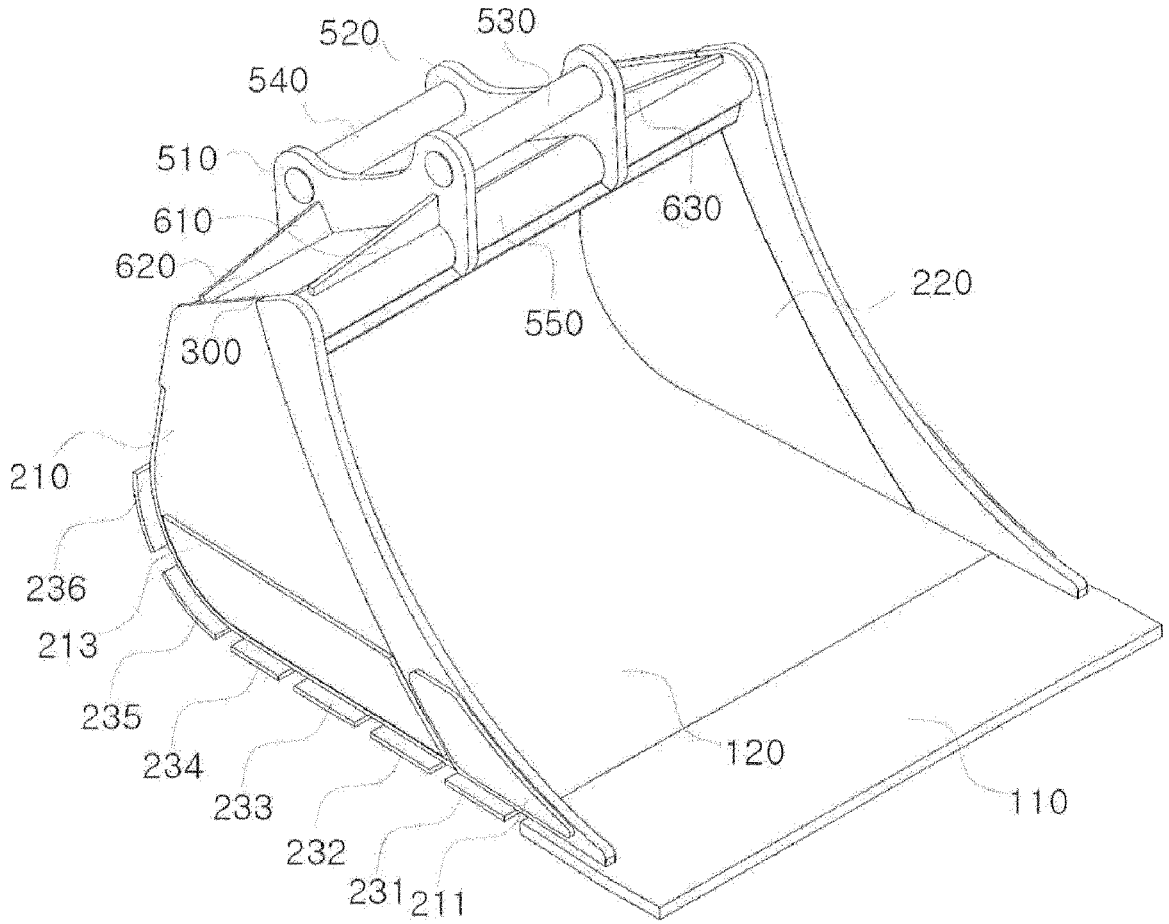
FIG. 1 is a perspective view illustrating a bucket for an excavator according to an embodiment of the disclosure.

In the following, embodiments according to the disclosure will be described with reference to the appended drawings. Regarding reference numerals assigned to elements in each drawing, it should be noted that like reference numerals designate like elements, wherever possible, even though they are illustrated in different drawings. In addition, in describing the embodiments of the disclosure, the detailed descriptions of well-known related elements or features will be omitted when it is deemed that such description interferes with the understanding of the embodiments of the disclosure. Moreover, while the specific embodiments of the disclosure will be described below, the technical idea of the disclosure is not restricted or limited thereto, but various modifications and variations may be made by a person skilled in the art.

Throughout the specification, when an element is referred to as being "connected" to another element, the element is "directly connected" to the other element with one or more intervening elements interposed therebetween. It will be further understood that the terms "comprises," "comprising," "includes" and/or "including," when used in this specification, specify the presence of stated features, integers, steps, operations, elements, and/or components, but do not preclude the presence or addition of one or more other features, integers, steps, operations, elements, components, and/or groups thereof.

Figure 2:
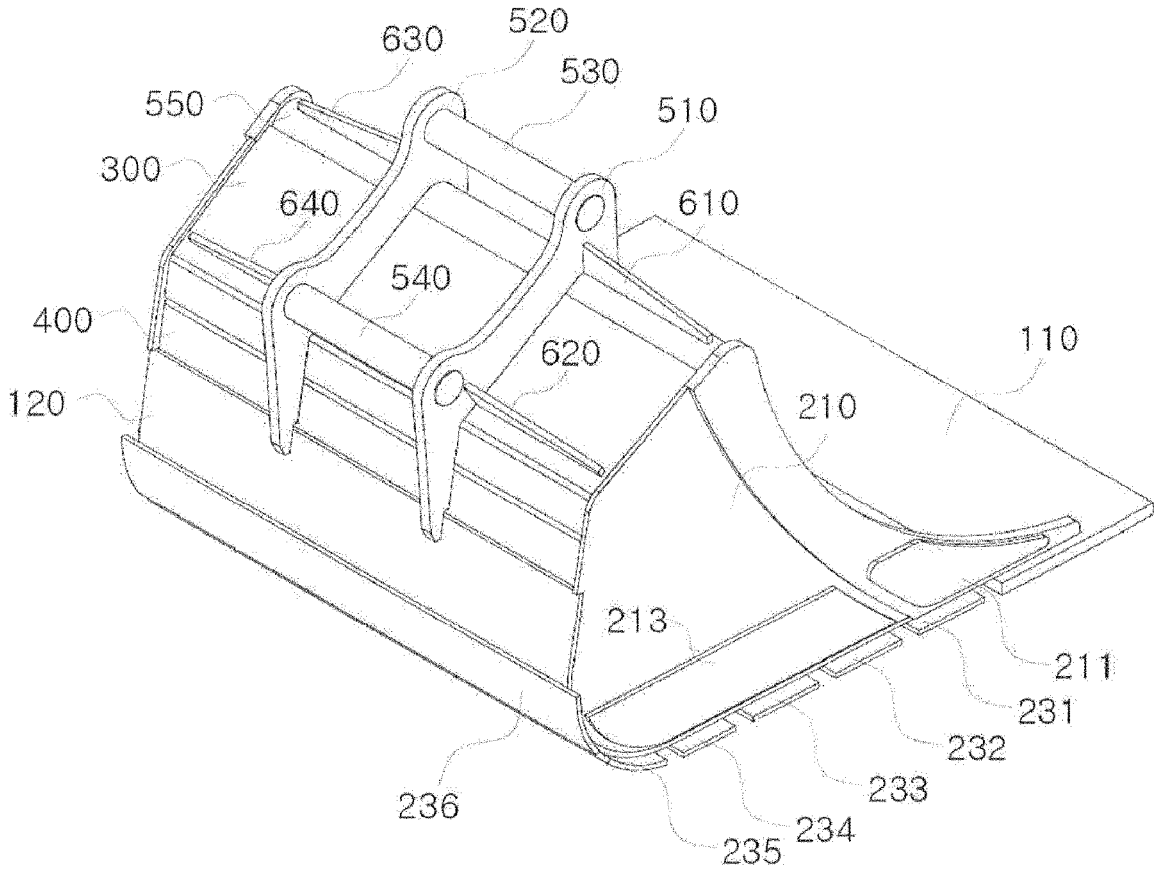
FIG. 2 is a rear-perspective view illustrating a bucket for an excavator according to an embodiment of the disclosure.

FIG. 1 is a perspective view illustrating a bucket for an excavator according to an embodiment of the disclosure, and FIG. 2 is a rear-perspective view illustrating a bucket for an excavator according to an embodiment of the disclosure.

Referring to FIGS. 1 and 2, a bucket for an excavator according to an embodiment of the disclosure may include bottom surface portions 110 and 120, a first side surface portion 210, a second side surface portion 220, a cover portion 300, a support portion 400, a first coupling bracket 510, a second coupling bracket 520, and a main body rod 550.

The bottom surface portions 110 and 120 may form a floor of the bucket for an excavator according to an embodiment of the disclosure and may include a first bottom surface portion 110 and a second bottom surface portion 120. The first bottom surface portion 110 may be formed in front to hold loads or dig in the ground, and the second bottom surface portion 120 may be formed in a shape of extending in a rearward direction and being bent upward. In order to enhance the strength of the bucket for an excavator according to an embodiment of the disclosure, at least one of bottom reinforcement portions 231, 232, 233, 234, 235, and 236 may be coupled to an outside of the second bottom surface portion 120. It is exemplary that a first bottom surface reinforcement portion 231 through a sixth bottom surface reinforcement portion 236 are coupled thereto, and the bucket for an excavator according to an embodiment of the disclosure may be provided with a various number of bottom surface reinforcement portions.

The first side surface portion 210 and the second side surface portion 220 may be coupled to both sides of the bottom surface portions 110 and 120, respectively. In order to enhance the strength of the bucket for an excavator according to an embodiment of the disclosure, at least one of side surface reinforcement portions 211 and 213 may be coupled to an outside of each of the first side surface portion 210 and the second side surface portion 220. Although only a first side surface reinforcement portion 211 and a second side surface reinforcement portion 213 are illustrated in FIGS. 1 and 2, a side surface reinforcement portion may be coupled to the outside of the second side surface portion 220 in a similar manner.

The cover portion 300 may have one area coupled to the main body rod 550 and may form an upper surface of the bucket for an excavator according to an embodiment of the disclosure. The first coupling bracket 510 and the second coupling bracket 520 may be coupled to an upper portion of the cover portion 300.

The support portion 400 may have one area coupled to the main body rod 550 and may have another area coupled to the second bottom surface portion 120. Specific shapes of the cover portion 300 and the support portion 400 are described below with reference to FIG. 3.

The first coupling bracket 510 may be coupled to the main body rod 550, the cover portion 300, and the support portion 400 and may be formed to protrude in a direction toward an outside of the bucket for an excavator according to an embodiment of the disclosure. The first coupling bracket 510 may include a plurality of rod holes formed laterally therethrough. As illustrated in FIGS. 1 and 2, the first coupling bracket 510 may include two rod holes, and a first coupling rod 530 and a second coupling rod 540 may be inserted into and coupled to the two rod holes, respectively. A bucket coupler of the excavator may be coupled to the first coupling rod 530 and the second coupling rod 540 so that a boom and the bucket of the excavator may be coupled to each other.

As illustrated in FIG. 2, the second coupling bracket 520 may be formed in the same shape as that of the first coupling bracket 510 at a position symmetrical to that of the first coupling bracket 510.

The main body rod 550 may be disposed between the first side surface portion 210 and the second side surface portion 220 and may be coupled to each of the first side surface portion 210 and the second side surface portion 220.

A first bracket reinforcement portion 610 may be coupled to one side surface of the first coupling bracket 510 and the main body rod 550, and a second bracket reinforcement portion 620 may be coupled to the one side surface of the first coupling bracket 510 and the cover portion 300. A third bracket reinforcement portion 630 may be coupled to one side surface of the second coupling bracket 520 and the main body rod 550, and a fourth bracket reinforcement portion 640 may be coupled to the one side surface of the second coupling bracket 520 and the cover portion 300.

Figure 3:
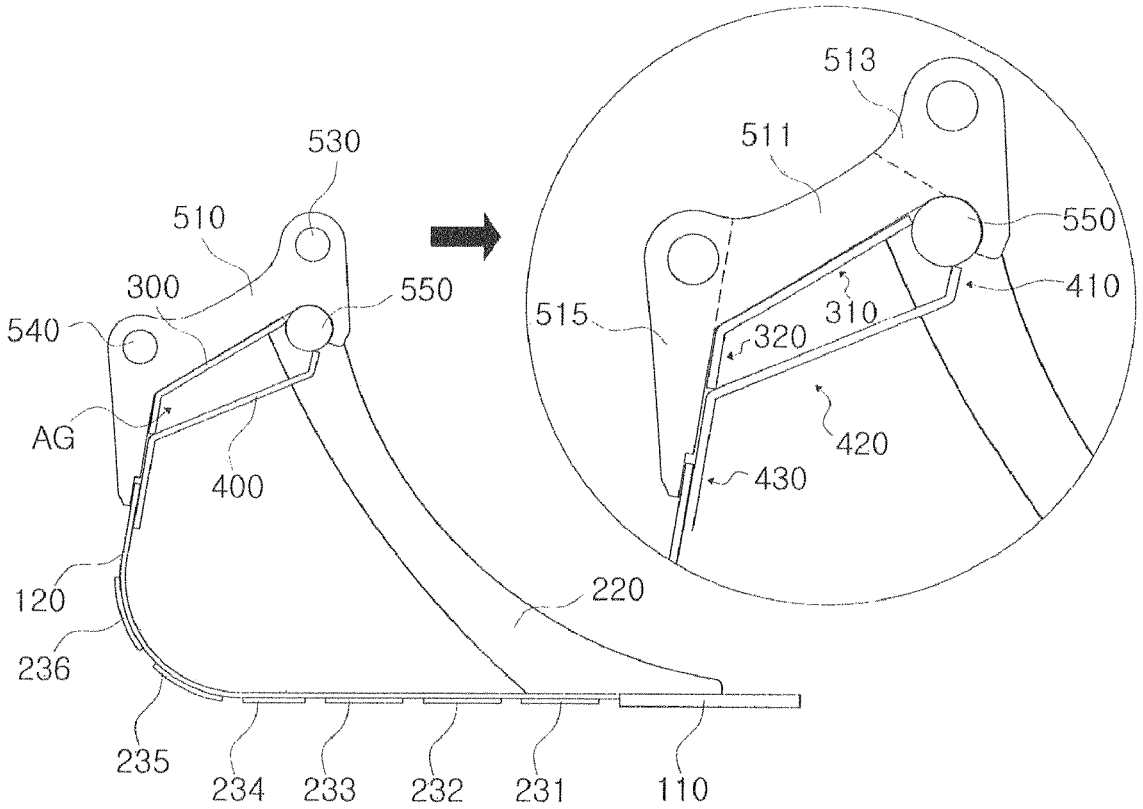
FIG. 3 is a side cross-sectional view illustrating a bucket for an excavator according to an embodiment of the disclosure.

FIG. 3 is a side cross-sectional view illustrating a bucket for an excavator according to an embodiment of the disclosure. FIG. 3 is a cross-sectional view in a vertical direction based on the first coupling bracket 510.

The cover portion 300 may include an upper extension portion 310 and a first rear surface portion 320. As illustrated in FIG. 3, the upper extension portion 310 may have one side coupled to the main body rod 550 and may be formed to extend in the rearward direction. The upper extension portion 310 may be formed in a flat shape without a portion protruding upward. The first rear surface portion 320 may be formed to be bent from the upper extension portion 310 and may have one side coupled to the support portion 400. As an example, an angle at which the upper extension portion 310 meets the first rear surface portion 320 may be an obtuse angle greater than 90°. As illustrated in FIG. 3, one side of the first rear surface portion 320 may be coupled to a point where a lower extension portion 420 and a second rear surface portion 430 meet while being bent.

The support portion 400 may include a rod coupling portion 410, a lower extension portion 420, and a second rear surface portion 430. The rod coupling portion 410 may have one side coupled to the main body rod 550. The lower extension portion 420 may be formed to be bent from the rod coupling portion 410 and may be formed to extend in the rearward direction. The upper extension portion 310 and the lower extension portion 420 may be formed to extend in the rearward direction, and a distance between the upper extension portion 310 and the lower extension portion 420 may become closer toward the rearward direction. The second rear surface portion 430 may be formed to be bent from the lower extension portion 420 and may have one side coupled to the second bottom surface portion 120. As illustrated in FIG. 3, an angle at which the rod coupling portion 410 meets the lower extension portion 420 and an angle at which the lower extension portion 420 meets the second rear surface portion 430 may each be an obtuse angle greater than 90°.

Referring to FIG. 3, the first coupling bracket 510 may include a central extension portion 511, a first rod insert 513 and a second rod insert 515. As an example, the central extension portion 511, the first rod insert 513, and the second rod insert 515 may be integrally formed.

The central extension portion 511 may be coupled to the main body rod 550 and the upper extension portion 310 and may be formed in a shape similar to a trapezoidal shape. Since the upper extension portion 310 is formed in a flat shape, a lower surface of the central extension portion 511 may be formed in a flat shape. An upper portion of the central extension portion 511 may not protrude and may be formed in a flat shape similar to that of the upper extension portion 310.

The first rod insert 513 may be coupled to the main body rod 550 and may be formed on one side of the central extension portion 511, and the first coupling rod 530 may be inserted into the first rod insert 513. A lower portion of the first rod insert 513 may be coupled in a shape of surrounding the main body rod 550.

The second rod insert 515 may be coupled to the first rear surface portion 320 and the second rear surface portion 430 and may be formed on the other side of the central extension portion 511. The second coupling rod 540 may be inserted into a rod hole formed in the second rod insert 515. The second rod insert 515 may be coupled to a rear surface of the bucket for an excavator according to an embodiment of the disclosure and may descend to the second bottom surface portion 120 to be coupled to the second bottom surface portion 120. That is, the first coupling bracket 510 may be formed so as to extend downward from the rearward direction and accordingly may also be coupled to the second bottom surface portion 120, thereby improving the strength of the bucket for an excavator.

The second coupling bracket 520 may be formed in the same shape as that of the first coupling bracket 510. As illustrated in FIG. 3, the cover portion 300 and the support portion 400 may have one side coupled to the main body rod 550 and may have the other side coupled to the first coupling bracket 510 and the second coupling bracket 520.

In other words, the bucket for an excavator according to an embodiment of the disclosure may have the cover portion 300 and the support portion 400 formed in a shape of being bent at least once and an inner cavity (AG) formed between the cover portion 300 and the support portion 400, the inner cavity formed in a space having a quadrangular or polygonal shape when viewed from a side surface and thus having an advantage of improving strength compared to a conventional bucket for an excavator.

Figure 4:
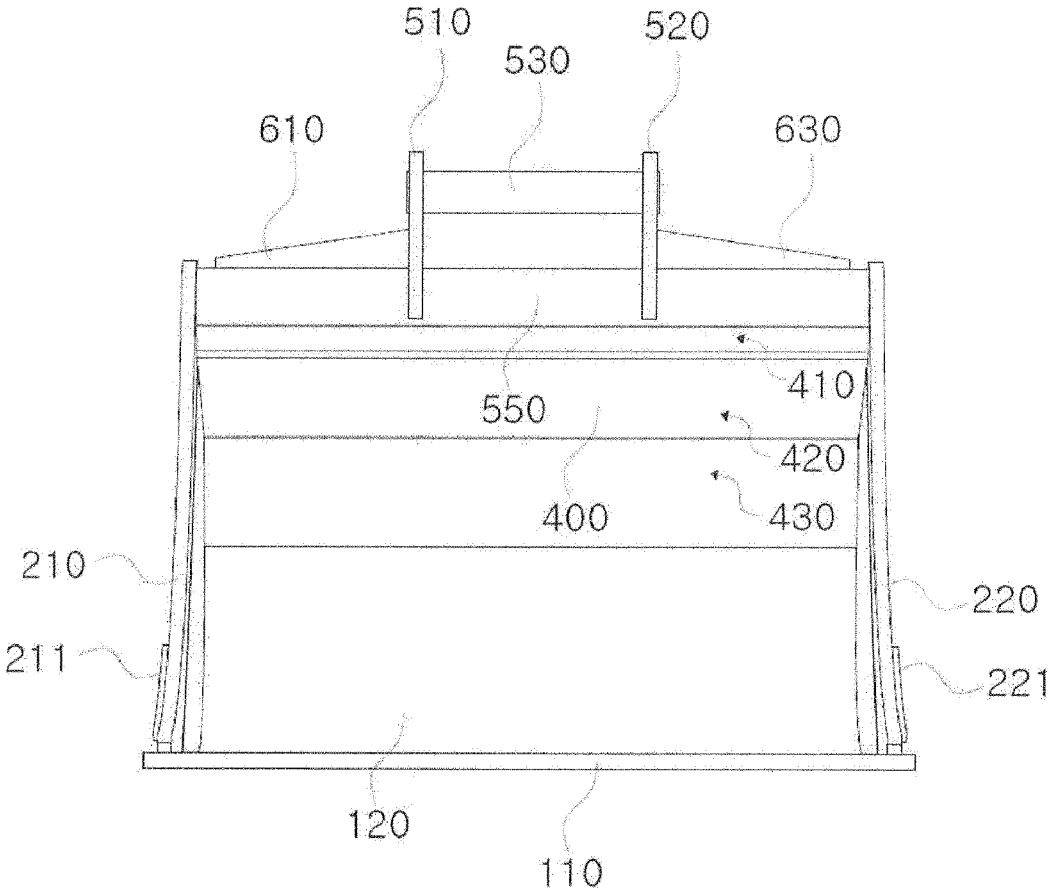
FIG. 4 is a front view illustrating a bucket for an excavator according to an embodiment of the disclosure.

FIG. 4 is a front view illustrating a bucket for an excavator according to an embodiment of the disclosure. Referring to FIG. 4, it can be seen that the rod coupling portion 410, the lower extension portion 420, and the second rear surface portion 430 that form the support portion 400 form an inner surface of the bucket for an excavator according to an embodiment of the disclosure together with the second bottom surface portion 120.

In the foregoing, the disclosure has been described in detail with reference to preferred embodiments illustrated in the drawings. These embodiments are only illustrative and not restrictive of the disclosure and are to be construed in the context of illustration and not restriction. The true technical scope of the disclosure should be determined not by the above description but by the technical idea of the appended claims. Although specific terms are used herein, they are used solely for the purpose of describing the concepts of the disclosure and are not intended to limit the scope of the disclosure as set forth in the claims. Each step of the disclosure need not necessarily be performed in the order described but can be performed in parallel, selectively, or separately. Those skilled in the art will appreciate that various modifications and equivalent embodiments are possible without departing from the essential spirit of the disclosure claimed in the claims. It is to be understood that equivalents include both currently known equivalents as well as equivalents developed in the future, i.e., all elements devised to perform the same function, regardless of the structure.

DESCRIPTION OF SYMBOLS

110: First bottom surface portion
120: Second bottom surface portion
210: First side surface portion
211: First side surface reinforcement portion
213: Second side surface reinforcement portion
220: Second side surface portion
221: Third side surface reinforcement portion
231: First bottom surface reinforcement portion
232: Second bottom surface reinforcement portion
233: Third bottom surface reinforcement portion
234: Fourth bottom surface reinforcement portion
235: Fifth bottom surface reinforcement portion
236: Sixth bottom surface reinforcement portion
300: Cover portion
400: Support portion
510: First coupling bracket
520: Second coupling bracket
530: First coupling rod
540: Second coupling rod
550: Main body rod
610: First bracket reinforcement portion -continued 620: Second bracket reinforcement portion
630: Third bracket reinforcement portion
640: Fourth bracket reinforcement portion
AG: Inner cavity

What is claimed is:

1. A bucket for an excavator, the bucket comprising:

a bottom surface portion configured to form a floor of the bucket for the excavator, the bottom surface portion formed to be bent upward while extending in a rearward direction;

a first side surface portion coupled to a first side surface of the bottom surface portion;

a second side surface portion coupled to a second side surface of the bottom surface portion;

a main body rod disposed between the first side surface portion and the second side surface portion, the main body rod coupled to each of the first side surface portion and the second side surface portion;

a cover portion having one area coupled to the main body rod, the cover portion configured to form an upper surface of the bucket for the excavator;

a support portion having one area coupled to the main body rod and the other area coupled to the bottom surface portion;

a first coupling bracket coupled to the main body rod, the cover portion, and the support portion, the first coupling bracket formed to protrude in a direction toward an outside of the bucket for the excavator; and a second coupling bracket formed at a position symmetrical to that of the first coupling bracket, wherein each of the first coupling bracket and the second coupling bracket comprises a plurality of rod holes formed laterally therethrough, and each of a first coupling rod and a second coupling rod is coupled to the plurality of rod holes on both the first and second coupling brackets, and the first coupling rod and the second coupling rod are configured to be coupled to a bucket coupler, wherein the cover portion and the support portion are formed in a shape of being bent at least once, and an inner cavity formed between the cover portion and the support portion is formed as a space having a quadrangular or polygonal shape in a cross-section view, the cover portion comprises:

an upper extension portion having one side coupled to the main body rod, the upper extension portion formed to extend in the rearward direction and formed in a flat shape without a portion protruding upward extending in response to positions between the first and second coupling rods; and a first rear surface portion formed in a shape of being bent from the upper extension portion, the first rear surface portion having one side coupled to the support portion, the support portion comprises:

a rod coupling portion having one side coupled to the main body rod;

a lower extension portion formed in a shape of being bent from the rod coupling portion, the lower extension portion formed to extend in the rearward direction; and a second rear surface portion formed in a shape of being bent from the lower extension portion, the second rear surface portion having one side coupled to the bottom surface portion, and a distance between the upper extension portion and the lower extension portion being closer toward the rearward direction.

2. The bucket for the excavator of claim 1, wherein each of the first coupling bracket and the second coupling bracket comprises:

a central extension portion coupled to the main body rod and the upper extension portion, the central extension portion formed in a trapezoidal shape;

a first rod insert coupled to the main body rod and formed on one side of the central extension portion, the first rod insert being that into which the first coupling rod is inserted; and a second rod insert coupled to the first rear surface portion and the second rear surface portion and formed on the other side of the central extension portion, the second rod insert being that into which the second coupling rod is inserted.

3. The bucket for the excavator of claim 1, further comprising:

at least one side surface reinforcement portion coupled to an outside of each of the first side surface portion and the second side surface portion to enhance a strength of the bucket for the excavator; and at least one bottom surface reinforcement portion coupled to an outside of the bottom surface portion to enhance the strength of the bucket for the excavator.

4. The bucket for the excavator of claim 1, further comprising:

a first bracket reinforcement portion coupled to one side surface of the first coupling bracket and the main body rod;

a second bracket reinforcement portion coupled to one side surface of the first coupling bracket and the cover portion;

a third bracket reinforcement portion coupled to one side surface of the second coupling bracket and the main body rod; and a fourth bracket reinforcement portion coupled to one side surface of the second coupling bracket and the cover portion.

5. The bucket for the excavator of claim 1, wherein each of the first coupling bracket and the second coupling bracket comprises:

a central extension portion coupled to the main body rod and the upper extension portion;

a first rod insert coupled to the main body rod and formed on one side of the central extension portion, the first rod insert accommodating the first coupling rod; and a second rod insert coupled to the first rear surface portion, the second rear surface portion, and the bottom surface portion, and formed on the other side of the central extension portion, the second rod insert accommodating the second coupling rod.

6. The bucket for the excavator of claim 1, the upper extension portion extends corresponding to the positions between the first and second coupling rods in the flat shape without the portion protruding upward and forms a flat channel between the upper extension portion and the first and second coupling rods, and the bucket coupler is configured to be coupled to the bucket through the flat channel.

* * * * *